US008172739B2

(12) United States Patent
Horn et al.

(10) Patent No.: US 8,172,739 B2
(45) Date of Patent: May 8, 2012

(54) DEVICE FOR COMBINING GROUPS OF FILTER SEGMENTS FOR PRODUCING MULTI-SEGMENT FILTERS OF THE TOBACCO INDUSTRY, AND TROUGH DRUM

(75) Inventors: Sönke Horn, Geesthacht (DE); Thorsten Scherbarth, Geethacht (DE); Stephan Wolff, Glinde (DE); Gerd Strohecker, Marschacht (DE); Steffen Rocktäschel, Lüneburg (DE); Wolfgang Steiniger, Geesthacht (DE); Heinz-Christen Lorenzen, Wentorf (DE); Uwe Heitmann, Hamburg (DE); Nikolaos Georgitsis, Hamburg (DE)

(73) Assignee: HAUNI Maschinenbau AG, Hamburg (DE)

( * ) Notice: Subject to any disclaimer, the term of this patent is extended or adjusted under 35 U.S.C. 154(b) by 0 days.

(21) Appl. No.: 10/490,165

(22) PCT Filed: Aug. 31, 2002

(86) PCT No.: PCT/EP02/09746

§ 371 (c)(1),
(2), (4) Date: Mar. 18, 2004

(87) PCT Pub. No.: WO03/024256

PCT Pub. Date: Mar. 27, 2003

(65) Prior Publication Data

US 2004/0237972 A1 Dec. 2, 2004

(30) Foreign Application Priority Data

Sep. 18, 2001 (DE) ..... 101 46 019
Nov. 2, 2001 (DE) ..... 101 55 292

(51) Int. Cl.
*B31C 99/00* (2009.01)

(52) U.S. Cl. ..... 493/39; 493/42; 493/47

(58) Field of Classification Search ..... 493/39, 493/42, 46, 47, 48, 50
See application file for complete search history.

(56) References Cited

U.S. PATENT DOCUMENTS

| | | | | |
|---|---|---|---|---|
| 3,357,320 | A | | 12/1967 | Sexstone et al. |
| 3,368,460 | A | | 2/1968 | Schubert |
| 3,487,754 | A | * | 1/1970 | Flasdieck ..... 493/42 |
| 3,724,339 | A | * | 4/1973 | Metzinger et al. ..... 493/4 |
| 4,010,678 | A | | 3/1977 | Greve et al. |
| 4,036,119 | A | | 7/1977 | Schubert et al. |
| 4,301,816 | A | * | 11/1981 | Wahle et al. ..... 131/88 |
| 4,312,698 | A | * | 1/1982 | Gergely ..... 156/441 |
| 4,324,540 | A | * | 4/1982 | Sexstone et al. ..... 425/385 |

(Continued)

FOREIGN PATENT DOCUMENTS

CH 531316 12/1972

(Continued)

OTHER PUBLICATIONS

Japanese Office Action dated Aug. 28, 2008, JP Application No. 2003-528159, and English translation.

(Continued)

*Primary Examiner* — Sameh H. Tawfik
(74) *Attorney, Agent, or Firm* — Venable LLP; Robert Kinberg; Leigh D. Thelen

(57) ABSTRACT

A device for combining groups of at least two different types of filter segments for producing multi-segment filters in the tobacco industry in a continuous process includes a plurality of independent functional units that are each designed as a module.

12 Claims, 13 Drawing Sheets

U.S. PATENT DOCUMENTS

| | | | | |
|---|---|---|---|---|
| 4,369,796 | A * | 1/1983 | Hall | 131/95 |
| 5,558,103 | A | 9/1996 | Garthaffner et al. | |
| 5,984,851 | A | 11/1999 | Irikura | |
| 6,427,699 | B1 * | 8/2002 | Schlisio et al. | 131/94 |

FOREIGN PATENT DOCUMENTS

| | | | |
|---|---|---|---|
| DE | 1 246 496 | B | 8/1967 |
| DE | 1 632 180 | A1 | 10/1970 |
| DE | 25 20 026 | | 2/1976 |
| DE | 25 34 666 | A1 | 4/1976 |
| DE | 24 52 749 | A1 | 5/1976 |
| DE | 28 11 176 | A1 | 9/1979 |
| DE | 61-076238 | | 4/1986 |
| DE | 03-003745 | | 1/1991 |
| DE | 03-190631 | | 8/1991 |
| DE | 689 10 669 | T2 | 6/1994 |
| DE | 198 58 600 | A1 | 6/2000 |
| DE | 695 28 549 | | 10/2002 |
| EP | 0 383 970 | B1 | 11/1993 |
| EP | 0 645 307 | | 9/1994 |
| GB | 1264483 | | 2/1972 |

OTHER PUBLICATIONS

Examination Report from the German Patent Office, dated Oct. 27, 2010, issued in Counterpart German Patent Application No. 101 46 019.8-23.

German Examination Report dated Jul. 5, 2010, issued in related German Patent Application No. 101 55 292.0, and an English-language translation.

Abstract of JP-7-265051, Oct. 17, 1995.

Japanese Examination Report issued on mailed Jan. 15, 2008.

* cited by examiner

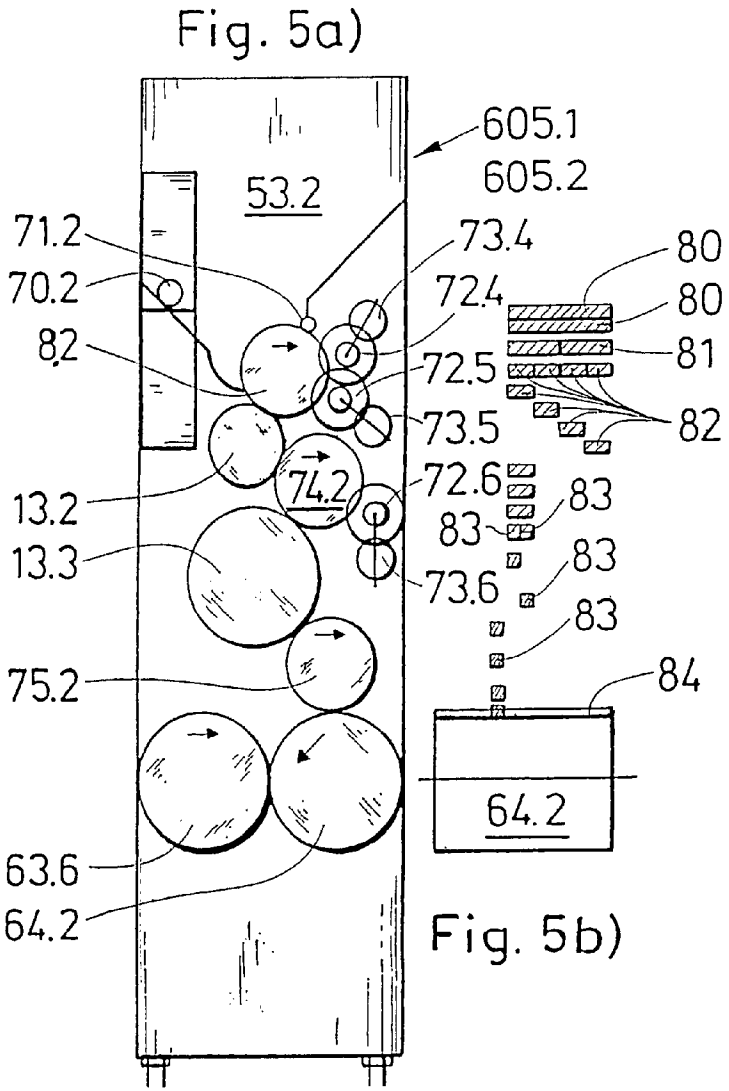
Fig. 5a)
Fig. 5b)
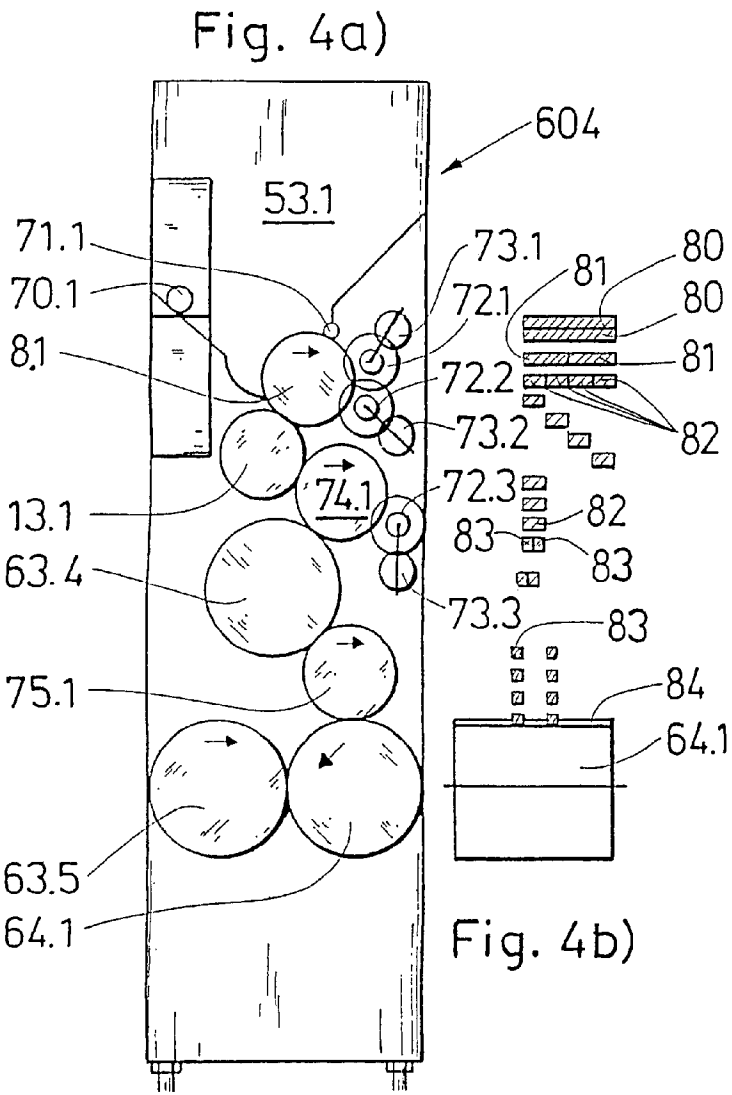
Fig. 4a)
Fig. 4b)

DEVICE FOR COMBINING GROUPS OF FILTER SEGMENTS FOR PRODUCING MULTI-SEGMENT FILTERS OF THE TOBACCO INDUSTRY, AND TROUGH DRUM

BACKGROUND OF THE INVENTION

The invention relates to a device for combining groups of filter segments for producing multi-segment filters of the tobacco industry in a continuous process, wherein at least two different types of filter segments are provided for each multi-segment filter.

The invention furthermore relates to a trough drum for axially positioning rod-shaped articles that are to be cut and/or are cut of the tobacco industry in longitudinal direction, said trough drum comprising mobile alignment stops that extend into the holding troughs. The tobacco industry desires to produce multi-segment filters comprising different segments that are made, for example, from different types of material. These materials may include, for example, cellulose acetate, paper, non-woven material, granulate, sintered elements, hollow cylinders or hollow chambers, capsules and the like. Multi-segment filters of this type, which also include the term "multiple filters" for the purpose of this invention, are wrapped for example with a wrapping material such as paper after the filter segment groups are formed, e.g. in a continuous process, and are then cut into filter rods having two times, four times or six times the usable filter rod length, such that they can be processed further.

A continuous process device is known from reference DE-OS 24 52 749, which corresponds to reference GB 15 22 139 and was filed by the legal predecessor of the applicant. With this device, groups of filter segments and/or groups of filter rods are formed with the aid of a group-forming device operating with the lateral positioning method and are then transferred to the continuous process device, such that the groups of filter rods can be enveloped in longitudinal axial direction with wrapping material. However, the group-forming device used in this case is a device that must be replaced completely if the filter segments themselves change or if the sequence of the filter segments changes.

This replacement involves high financial expenditure along with a low variability in the production of the multiple filters.

The applicant's machine KDF 2E is a typical continuous process device while applicant's machine GC E is a typical group-forming device. Both devices are well known in the trade and are marketed in the form of a combination machine of the type MULFI E.

In order to transfer of the groups formed with the group-forming device to the continuous process device, we want to point to reference DE-OS 25 34 666, which corresponds to reference U.S. Pat. No. 4,044,659. The content of this patent application as well as the content of the DE-OS 24 52 749 is to be incorporated into the disclosure content of the present application.

Reference DE 198 58 600 A1 by the applicant also discloses a device for axially positioning in longitudinal direction the rod-shaped articles of the tobacco industry which must be cut. This device in particular uses a trough drum by means of which staggered and sequentially following filter rods are moved to form a cross-axial row, such that a cut for separating the filter rods can be made.

SUMMARY OF THE INVENTION

It is the object of the present invention to modify the above-described device for combining groups of filter segments for producing multi-segment filters in such a way that the multiple filter production can be varied. The respective device furthermore should be cost-effective, in particular with respect to the variability of producing different types of multiple filters. In addition, it should be possible to reconfigure the device for producing multiple filters of a different type with maximum time saving. Finally, it is the object of the present invention to provide a space-saving design option of the device for combining groups of filter segments for producing the multi-segment filters, wherein the respective operational steps that can be carried out with such devices should furthermore be realizable on a shortened conveying path.

This object is solved for a device that combines groups of filter segments for producing multi-segment filters of the tobacco industry by using a continuous process, wherein at least two different types of filter segments are provided for each multi-segment filter and wherein the device is subdivided into a plurality of autonomous functional units.

The highest degree of variability can be achieved for the multiple filter production as a result of the device being subdivided into a plurality of autonomous functional units, wherein a quick and cost-effective adaptation is possible if the production of different multiple filters is desired. If applicable, the autonomous functional units need only be rearranged and adapted and/or only a few additional modules must be obtained and added. Within the framework of this invention, the term "functional units" also includes the term "module." For the purpose of this application, the term divisibility of the functional units in particular means that the functional units are combination units.

A particularly space-saving design can be realized if one functional unit is provided for each type of filter segment of a multi-segment filter. A particularly high variability of the device is possible if one and in particular a single functional unit is provided for each filter segment of a multi-segment filter. Combining groups of filter segments can be particularly easy if the plurality of autonomous functional units is arranged in a row, such that at least some of the conveying elements of two adjacent functional units are operatively connected, in particular if they engage. The filter segments are conveyed along a meandering path by the conveying elements, wherein the filter segments are transferred in the region of the operative connection from one conveying element to an adjacent conveying element. Filter segments can thus be combined particularly easily on these conveying elements. The conveying elements preferably comprise combining drums and/or transfer drums. A preferred and simple embodiment of the device is achieved if the conveying elements that transfer the filter segments and/or filter-segment groups are arranged in a horizontal row. Each functional unit preferably comprises at least one combining drum. The group of filter segments preferably can be conveyed cross-axially positioned by the conveying elements, so that the device and also the autonomous functional units can have a correspondingly compact design.

A particularly preferred embodiment of the device according to the invention is obtained if at least one conveying belt is provided with holding troughs for holding the filter segments, which troughs are positioned crosswise to the conveying direction, wherein at least two adjacent functional units respectively comprise at least one conveying element having respectively one location of transfer to the at least one conveying belt.

As a result of this preferred embodiment of the invention, a particularly low-noise device is possible since a plurality of combining drums and transfer drums are omitted that generate noise as a result of suction air and compressed air switching operations. Furthermore, the continuous movement of a conveying belt and/or several side-by-side arranged conveying belts that move in the same direction ensures a very careful transport of the filter elements and/or the filter segments, thereby dispensing with the need for further steps to transport even extremely sensitive filter segments. Finally, the operating personnel advantageously can observe the filter segments on the conveying belt and/or belts constantly and can intervene accordingly if a malfunction occurs.

Each functional unit preferably comprises at least one conveying element having a transfer location to the at least one conveying belt. With this embodiment of the device according to the invention, the conveying belt and/or belts extend over all functional units, so that all assembly and transfer drums can be omitted, which are provided in the other embodiments for the horizontal transport of the filter segments to a continuous process unit, e.g. the applicant's KDF 2E machine.

The conveying direction of the conveying belt preferably is horizontal. A highly secure filter transport of the segments is possible if means are provided for securing filter segments inside the holding troughs. A tightly pushed together filter rod group can be produced if at least one means for displacing filter segments inside the holding troughs is provided. Furthermore, at least one cleaning element is preferably provided for cleaning the at least one conveying belt. Finally, several side-by-side arranged conveying belts are preferably provided that can move essentially parallel to each other.

For a particularly preferred embodiment of the invention, a multi-segment filter production machine is realized with a continuous processing device and a transfer device for transferring groups of filter segments from a device according to the invention, as described in the above, and/or a preferred embodiment of the above-described device, to the continuous processing device.

The invention is furthermore solved with a trough drum for axially positioning rod-shaped articles of the tobacco industry that must be cut and/or are cut in longitudinal direction inside the holding troughs, wherein the drum is provided with mobile alignment stops that extend in particular into the holding troughs. For this, at least one positioning means is provided for positioning at a distance to each other two rod-shaped articles of the tobacco industry, which are arranged side-by-side in longitudinal axial direction inside a holding trough. The design of the trough drum according to the invention makes it possible to provide more functions on a conveying drum, so that the total number of drums for a functional unit according to the invention can be reduced, thus resulting in a particularly space-saving design for respective autonomous functional units and/or devices for assembling groups of filter segments for producing multi-segment filters of the tobacco industry. The number of drums can additionally be reduced if a cutting means is furthermore assigned to the trough drum. If the one positioning means for positioning at a distance comprises preferably at least one suction-air channel, the rod-shaped articles can be moved with the aid of activated suction-air channels in the most careful, quick and easy way. If at least two suction channels are provided, which are arranged on opposite ends of the holding trough in longitudinal axial direction, two rod-shaped articles that are arranged side-by-side in longitudinal direction can be positioned particularly easy at a distance to each other. Positioning two rod-shaped articles in longitudinal axial direction at a distance to each other is even easier if a ventilation opening is preferably provided in a trough cover. The ventilation opening is preferably arranged in the trough cover in such a way that air can flow between two rod-shaped articles that are arranged adjacent to each other in longitudinal axial direction.

If means are preferably provided for transferring the articles, held staggered inside successively following, cross-axially positioned holding troughs, to a cross-axially aligned position so that they can advantageously be cut, three operating steps in particular can be realized with the trough drum. These steps involve cross-axially aligning these articles, which are held staggered inside cross-axially successively following holding troughs, cutting the articles and positioning the cut articles at a distance to each other. The trough drum therefore can also be called a pushing/cutting/pushing drum.

To achieve a quick cutting alignment along the shortest possible conveying path, it is furthermore suggested that the alignment stops acting upon one front of the articles can be displaced in longitudinal direction, relative to the holding troughs. In this way, the filter-rod components and/or rod-shaped articles that previously make contact on one side can yield during the cutting operation.

To precisely coordinate the successively following alignment and yielding movements of the alignment means, one modification calls for providing the alignment stops with actuating means for moving them forward to a defined end position outside of the effective range of the cutting means which is designed as circular blade, and pulling them back from the end position in the effective range of the cutting means. It is useful if the actuators are designed as wobble plates that rotate on the front end along with the trough drum.

To ensure with simple means a defined longitudinal axial and cross-axial orientation of the articles and/or the article row, relative to the cutting means, it is furthermore provided that in the end stop region, the alignment stops are provided with a recess that extends over the complete trough bottom of the holding troughs, wherein suction channels that operate jointly with the alignment stops empty into this area. According to an additional suggestion, a secure suction effect is ensured in that the suction channels can be activated within an alignment zone that is defined by the circumferential covering of the trough drum.

To make possible and/or be able to select in each case an article positioning that meets requirements, in particular in a joint operation between the pushing/cutting/pushing drum and the following drum, it is furthermore suggested that the alignment stops, which dip into the holding troughs, with their actuators are arranged on at least one front end of the trough drum or, alternatively, on both front ends of the trough drum.

The advantage achieved with this solution is that three operational steps that normally hinder each other can be realized on a single conveying drum, thereby doing away with the three-drum arrangement. Reduced are consequently the dimensions and/or structural size of the machine unit, which on the whole are determined by the vertical and horizontal axial spacing between the conveying drums, meaning the independent functional units and the device for combining groups of filter segments for producing multi-segment filters and in the final analysis also the multi-segment filter production line.

The object is finally also solved with an independent functional unit, in particular for adding filter segments to other filter segments, by means of which groups of filter segments can be combined for producing multi-segment filters of the tobacco industry in a continuous process. As described in the above, the functional unit in this case comprises at least one trough drum according to the invention or a modification thereof.

One particularly preferred embodiment is obtained if a device according to the invention and/or a modification thereof for combining groups of filter segments for producing multi-segment filters of the tobacco industry in a continuous process is provided with at least one trough drum according to the invention or a modification thereof, as described in the above. A multi-segment filter production machine is preferably provided with at least one trough drum according to the invention or a modified trough drum of the above-described type.

BRIEF DESCRIPTION OF THE DRAWINGS

The invention is explained in further detail in the following, without restricting the general inventive idea, by using exemplary embodiments and referring to the drawings, wherein we explicitly refer to the drawings for all details not further explained in the text. Shown are in:

FIG. 4*a*) An embodiment of a functional unit according to the invention for soft elements, shown in a schematic representation.

FIG. 4*b*) A schematic arrangement of filter segments according to their position in the respective drums, as shown in FIG. 4*a*).

FIG. 5*a*) A schematic representation of a different embodiment of a functional unit according to the invention for soft elements.

FIG. 5*b*) A schematic arrangement of filter segments, showing the placement on the drums as in FIG. 5*a*).

DETAILED DESCRIPTION OF THE INVENTION

In the following description of the Figures, the same elements are in part given the same reference numbers and will not be introduced again.

Figure 1:
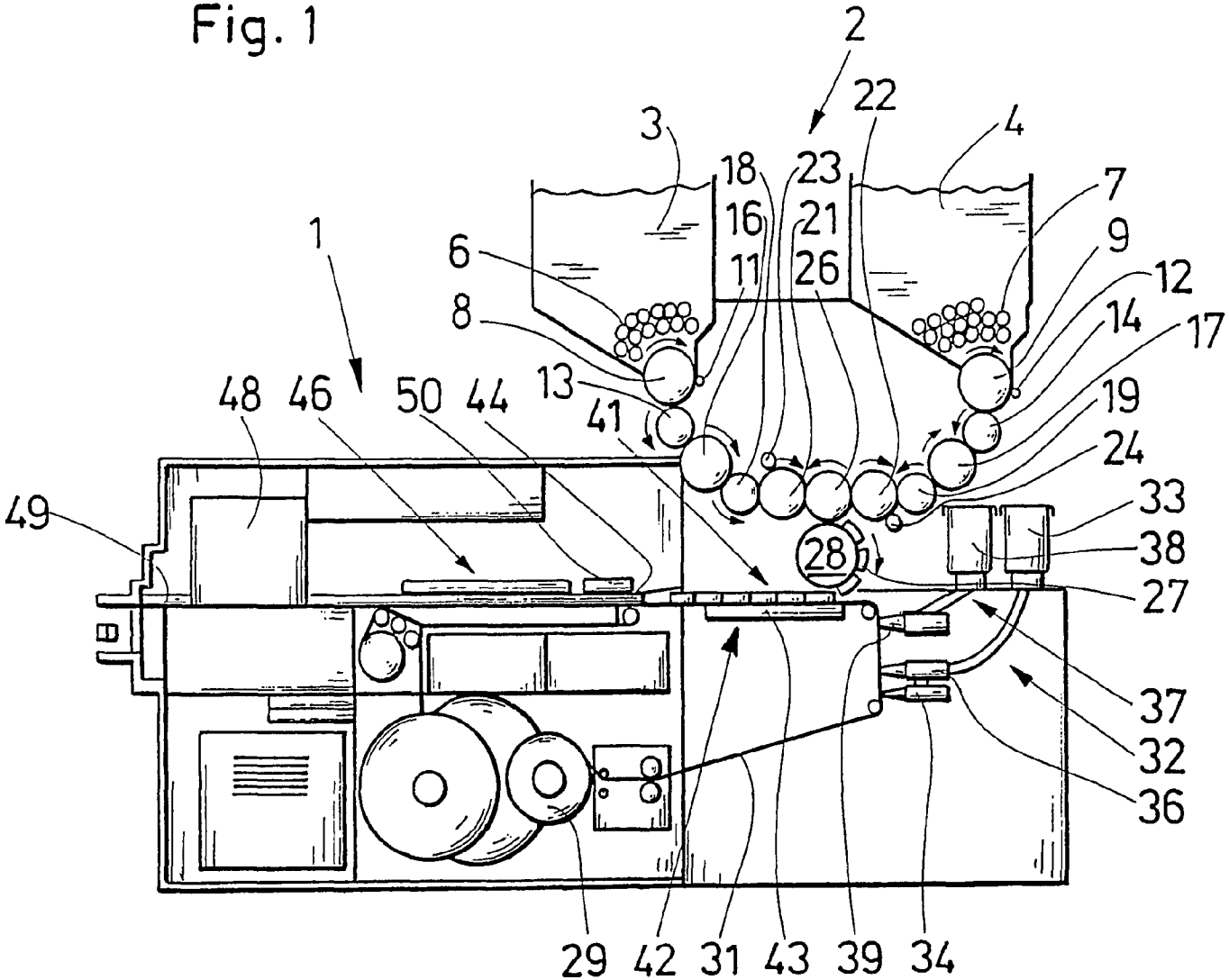
FIG. 1A schematic view from the side of a multi-segment filter production machine, comprising a continuous process device and a group-forming device according to the reference DE-OS 24 52 749.

The multi-segment filter production machine according to the prior art, shown in FIG. 1, is configured as follows:

A group-forming device 2 that operates with the lateral processing method is assigned to the continuous process device 1 and is provided with two storage containers 3 and 4 which contain filter rods 6 and 7 of a first and/or second type. The removal drums 8 and/or 9, to which respectively one cutting device 11 and/or 12 is assigned, for cutting the filter rods 6 and/or 7 coming from the storage containers 3 and 4, are located at the lower, discharge-side ends of the storage containers 3 and 4. They are followed by respectively one staggering drum 13 and/or 14, on which the filter segments, formed when the filter rods 6 and/or 7 are cut, are arranged in a staggered formation and are subsequently displaced with respectively one pushing drum 16 and/or 17, such that they form a row following each other in cross-axial direction. The rows of filter segments, formed in this way, are subsequently pulled apart with respectively one accelerating drum 18 and/or 19, so that the distances between the individual filter segments are increased.

Following this, the filter segments are again cut on cutting drums 21 and/or 22, to which respectively one cutting device 23 and/or 24 is assigned. The newly cut filter segments are simultaneously pulled apart on the cutting drums 21 and/or 22, so that larger gaps form between the individual element. On a combining drum 26, filter rod elements of the respectively other type are subsequently inserted into these gaps and filter groups 27 are formed in this way, which are composed of several elements of the different filter types. The filter rod groups 27 are subsequently aligned in longitudinal axial direction to the conveying direction by a turnover means in the form of a transfer device and/or turning drum 28 and are transferred without gaps continuously onto a wrapping paper tape 31, pulled off a bobbin 29, in the continuous processing device 1, wherein the transfer takes place as described, for example, in reference DE-OS 25 34 666.

Glue is applied to this wrapping paper tape 31 before the filter rod groups 27 are deposited onto the wrapping paper tape. A first glue application device 32 that is indicated by a glue container 33 and two application nozzles 34 and 36 are provided for applying glue to the inside of the wrapping paper tape 31 in the form of two parallel, side-by-side arranged bands of glue. A second glue application device 37, indicated by a glue container 38 and a glue application nozzle 39, applies a band of glue along the edge of the wrapping paper tape 31 for the seam. Of course, it is possible to apply only one band of glue or more than two bands for the inside glue application.

For one application case, the glue container 33 of the first glue-application device 32 contains a cold glue and the glue container 38 of the second glue application device 37 contains a hot-melt glue. A means 42 in the form of a heating device 43 for curing the inside glue is provided below the wrapping paper tape 31, meaning in the deposit region 41 of the turning drum 28. This heating device ensures that the glue applied to the inside by the glue-application nozzles 34 and 36 is cured immediately after the filter-rod groups 27 are deposited thereon and that the filter rod-groups 27 are secured in this way immediately following the deposit on the wrapping paper tape 31, so that they cannot be displaced again through external influences, such as subsequently arriving filter-rod groups.

The heating device 43 simultaneously activates the hot-melt glue for the glue application to the seam. The filter-rod groups 27, which are thus fixated in a continuous row, subsequently pass through a format unit designed as format chamber 44, in which the wrapping paper tape 31 is wrapped around the filter-rod groups 27 to form a continuous filter rope, wherein the hot-melt glue for the seam, applied with the glue-application nozzle 39, is cured within a glue chamber 46 that is designed as cooling device 47 for this purpose. The filter rope that is closed and sealed in this way subsequently reaches a cutting device 48 in which combination filter rods 49 of preferably multiple lengths are cut off. Each of these multiple length filter rods contains filter elements composed of the different types of filter rods 6 and 7.

Figure 2:
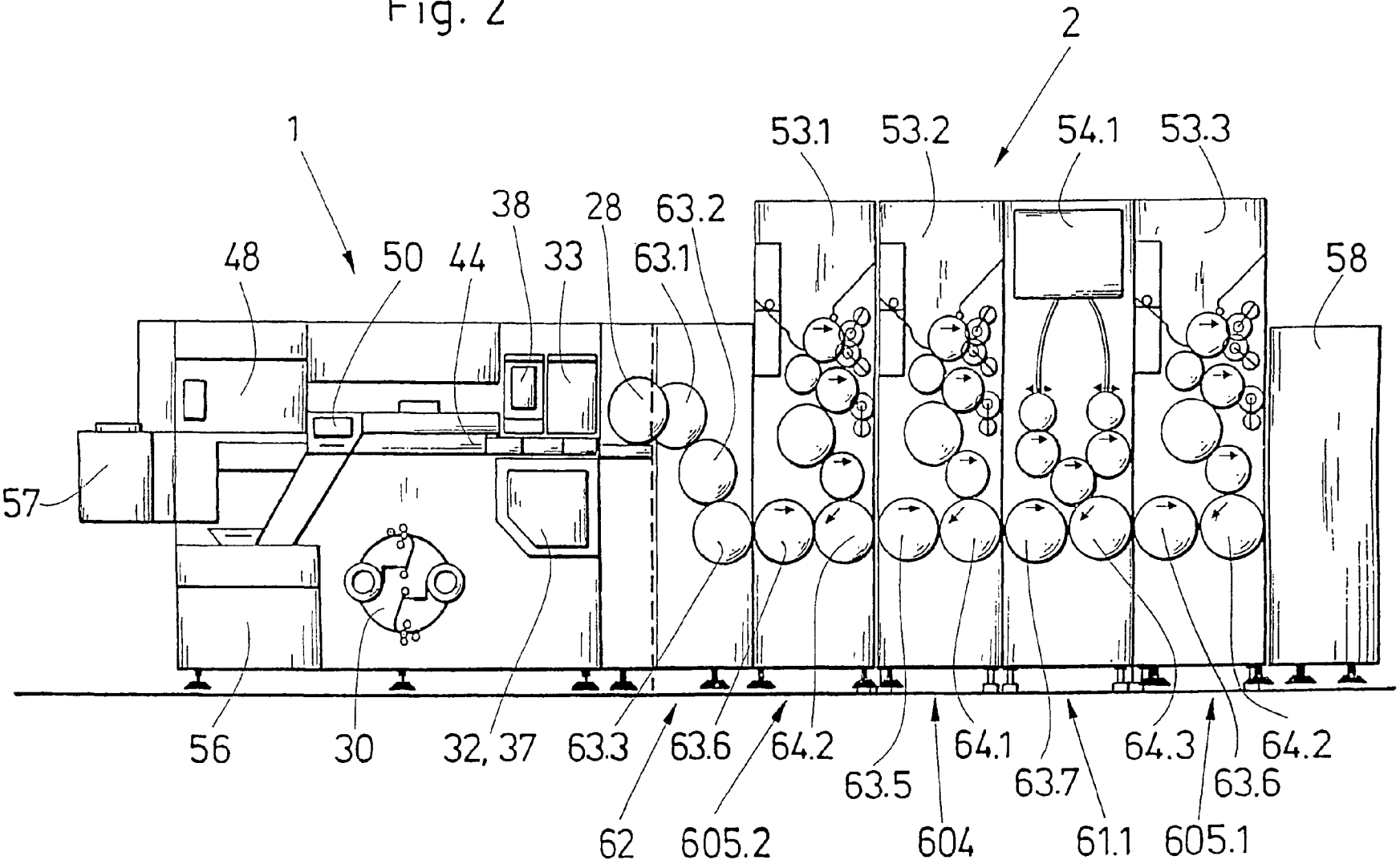
FIG. 2A schematic view from the side of a first embodiment of a multi-segment filter production machine according to the invention with a continuous process device and a group-forming device.

FIG. 2 shows a multi-segment filter production machine according to the invention, provided with a device according to the invention for combining groups of filter segments for producing multi-segment filters. The continuous process device 1 corresponds essentially to the continuous process device 1 shown in FIG. 1, wherein a rope cutter 50 is also indicated in FIG. 2 by means of which the filter rope can be cut at the start of the rope formation, precisely at the moment where the filter segments are wrapped successfully and methodically with wrapping material. The cut-off section of the filter rope then slides via a slide into a waste container 56. A push-in drum 57 is furthermore shown for the continuous process device 1. The push-in drum 57 functions to push filters with n-times the usable length, e.g. 2, 4, or 6 times the usable length, into a different machine for further processing, in particular for combining them with tobacco rods.

FIG. 2 furthermore shows the device for assembling groups of filter segments for the production of multiple filter segments according to the invention. This also relates to a group-forming device 2, but shows the use of independent functional units 604, 605.1, 605.2 and 61.1 in each case. The functional unit 604 is a soft-element unit that supplies two individual filter segments (FIG. 4*a*), the functional units 605.1 and 605.2 are soft-element units that respectively supply a single filter plug and/or a single filter segment with double the usable length while the functional unit 61.1 is a hard-element unit. Supply containers 53.1-53.3 and 54.1 are respectively provided in the functional units. Naturally, a soft-element supply container 53.1-53.3 is provided for the soft-element unit 605.1, 605.2 and/or 604 and a hard-element supply container 54.1 is provided for the hard-element unit 61.1. Soft segments or soft elements, e.g. composed of a cellulose acetate or a non-woven material, are processed in the soft-element units 604 and 605.1 and 605.2 and the processed segments are then deposited on a drum. In the hard-element unit 61.1, on the other hand, hard segments such as sintered granulate, granulate-filled sleeves or empty sleeves are positioned on a drum. An energy-supply unit 58 supplies energy to the group-forming device 2 and/or the independent functional units.

Multi-segment filters for cigarettes that comprise four filter elements, for example, can be produced with the multi-segment filter production machine according to FIG. 2.

A soft element with double the usable length is inserted, for example, in the center of the respective trough 84 on the combining drum 64.2 (see FIG. 5*a*). Hard elements can then be arranged adjacent to this soft element with double the usable length, followed by two soft elements placed with the aid of the functional unit 604 on the outside of the hard elements. Finally, using the functional unit 605.2 that is closest to the transfer unit 62, another soft element with double the usable length is positioned laterally axially aligned to the left or right of the group of filter elements in the respective troughs of the transfer drum 63.6 and/or the combining drum 64.2. The filter-segment group formed in this way is then transferred to a transfer unit 62 and is deposited axially in longitudinal direction with the aid of the turning drum 28 that is known per se onto conveying means for the continuous process device 1. There, it is wrapped with the wrapping paper pulled from a bobbin 29, not shown in FIG. 2, and installed on a bobbin holder 30, to form a multiple filter rope. A standard filter wrapping paper can be used for this.

The invention therefore relates in particular a new group-forming device 2, which can be combined, for example with a KDF machine of the applicant, to form a filter-production line. Multiple filters can be produced, which are processed together with tobacco rods in the applicant's filter-attachment machine MAX as filter rods with 4 times or 6 times the usable length to form filter cigarettes.

Figure 3:
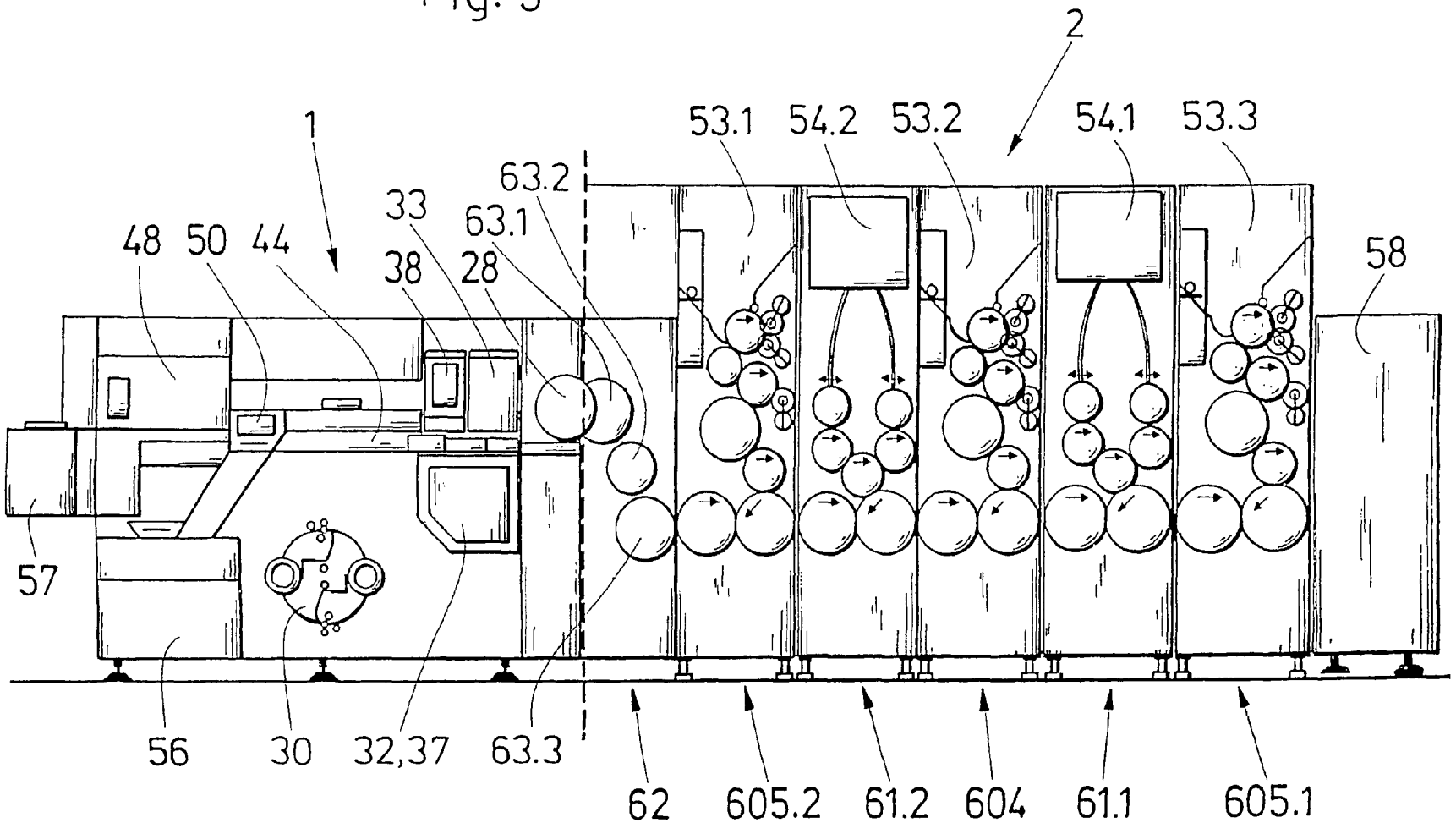
FIG. 3A schematic view from the side of a different exemplary embodiment of a multi-segment filter production machine according to the invention, with a continuous process device and a different group-forming device according to the invention.

FIG. 3 shows a variation and/or a different type of embodiment of the present invention as compared to FIG. 2. By comparison, FIG. 3 shows an additional hard element unit 61.2 that is inserted between the two soft elements units 604 and 605.2, shown on the left in FIG. 2. Multi-segment filters for cigarettes that comprise five different segments, for example, can be produced in this way.

The schematic representation in FIG. 4*a*) shows a soft element unit 604 according to the invention for supplying two individual filter segments. Soft filter rods 80, e.g. made of cellulose acetate, are fed via a feeder element 70.1 into a soft-element supply container 53.1. The respective filter rods and/or filter elements 80, e.g. with 8 times the usable length, are removed with a removal drum 8.1. The diverter roll 71.1 is provided for a secure removal of the filter elements 80. A device for removing rod-shaped articles from a supply container is known, for example, from reference DE 25 05 998 C2 that corresponds to the U.S. Pat. No. 4,020,973.

On the removal drum 8.1, the filter elements 80 are then cut into two filter elements 81 with four times the usable length with the aid of a first circular knife 72.1 that is driven rotatingly and is sharpened constantly on a grinding element 73.1. Two additional cuts are then made with two additional circular knives 72.2, arranged one after another, of which only the first circular knife can be seen in FIG. 4*a*), so that the filter elements 81 on the whole are cut into four filter elements 82 with double the usable length.

The four filter elements 82, which are arranged axially in longitudinal direction on the removal drum 8.1 as shown in FIG. 4*b*), are then transferred to a staggering drum 13.1 which staggers the filter elements 82, as indicated in FIG. 4*b*). This is followed by a transfer to a pushing/cutting drum 74.1 in which the filter elements 82 are initially aligned cross-axially and are subsequently cut with the circular knife 72.3 into two filter plugs 83. The filter plugs 83, produced in this way, are moved to a transfer drum 63.4 and are then transferred to a pushing/transfer drum 75.1 in which the filter plugs 83 are separated and pushed apart. Finally, the pushed-apart filter plugs 83 are moved to a combining drum 64.1 and then to a transfer drum 63.5, which can be operatively connected to a combining drum 64.2-64.5 of another functional unit. Thus, the filter elements deposited on the transfer drum 63.5 can be combined with the filter elements deposited on the additional combining drum 64.2-64.5.

Figures 4C, 4D:
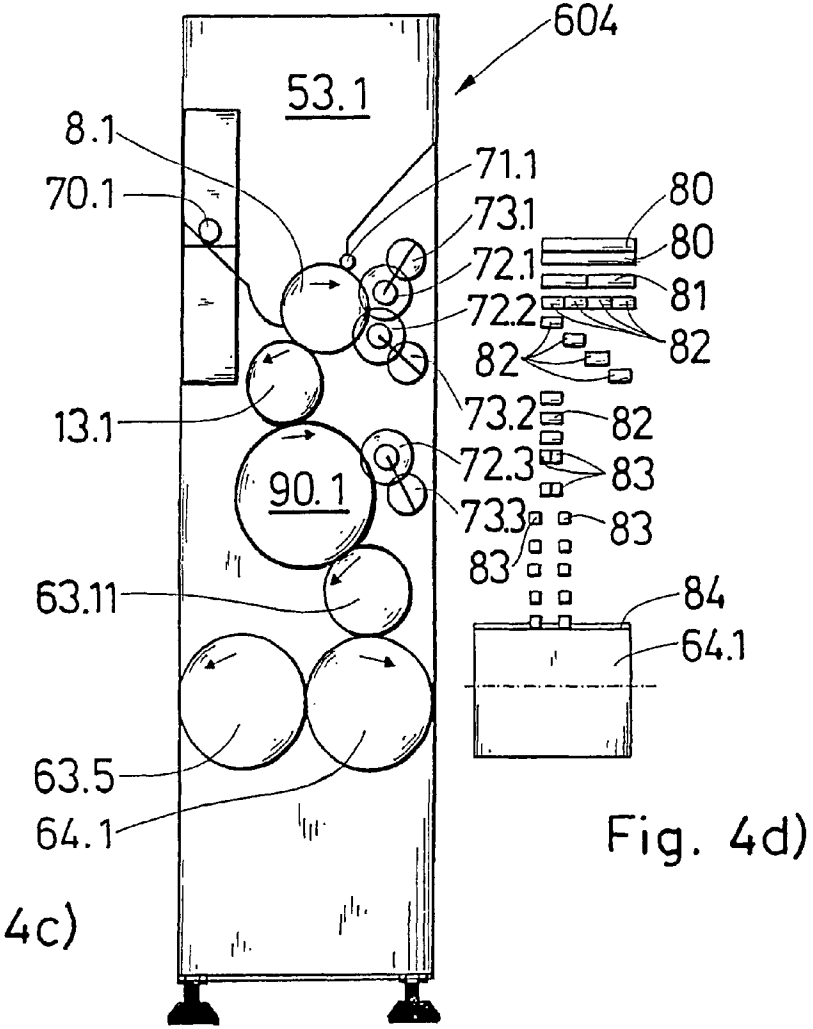
FIG. 4*c*) A schematic representation of a different embodiment of a functional unit according to the invention for soft elements, which is modified as compared to FIG. 4*a*).
FIG. 4*d*) A schematic arrangement of filter segments, positioned as shown in FIG. 4*c*) in the respective drums.

FIG. 4*c* schematically shows a different embodiment according to the invention of a soft element unit 604, which for the most part corresponds to the soft-element unit shown in FIG. 4*a*), but with a different design for some of the drums. The drums 74.1 and 63.4 arranged in FIG. 4*a*) are replaced by a single pushing/cutting/pushing drum 90. Furthermore, a transfer drum 63.11 replaces the pushing-transfer drum 75.1.

The pushing/cutting/pushing drum 90.1 essentially corresponds to the pushing/cutting/pushing drum 90 described in the following with reference to the FIGS. 7 and 8. The filter elements 80 to 83, shown in FIG. 4*d*), are processed in the same way as in FIG. 4*a*) until they reach the staggering drum 13.1. The staggering drum 13.1 staggers the filter elements with 2 times the usable length 82 and transfers these to the pushing/cutting/pushing drum 90.1. In this drum, the filter elements with 2 times the usable length are initially aligned cross-axially, are cut and then pulled apart in longitudinal axial direction. The correspondingly cut filter plugs 83 are then transferred with a correspondingly predetermined spacing in longitudinal axial direction to the transfer drum 63.11, which in turn transfers the filter plugs to the holding troughs 84 of the combining drum 64.1. The transfer drum could be eliminated, if necessary, from this exemplary embodiment by using a slightly different geometrical arrangement, so that the structural height of the soft-element unit 604 would be reduced.

FIG. 5*a*) shows a schematic representation of yet another exemplary embodiment of a functional unit 605.1 and/or 605.2 according to the invention. A single filter plug with double the usable length is supplied with this functional unit 605.1 and/or 605.2. The difference to the functional unit 604 in FIG. 4*a*) is that a staggering drum 13.3 is provided in place of the downstream installed first transfer drum 63.4 and is used for transferring the cut, staggered filter plugs 83 to the pushing/transfer drum 75.2. Thus, only one filter plug 83 is maximally arranged in each trough of the pushing/transfer drum 75.2 and/or in each trough of the thereto assigned combining drum 64.2 and the transfer drum 63.6. FIGS. 5*b*) and 4*b*) additionally show schematically the holding trough 84 of the combining drum 64.1 and/or 64.2. It is preferable if the first and last filter segment of a multi-segment filter are inserted with the aid of the functional unit according to FIG. 5*a*. However, with the functional unit 605.2 all previously inserted filter plugs 83, 87 are already arranged on the combining drum 64.2 and the transfer drum 63.6, and the newly supplied filter plug 83 with double the usable length is positioned on one side of the filter-segment group.

Figure 6A:
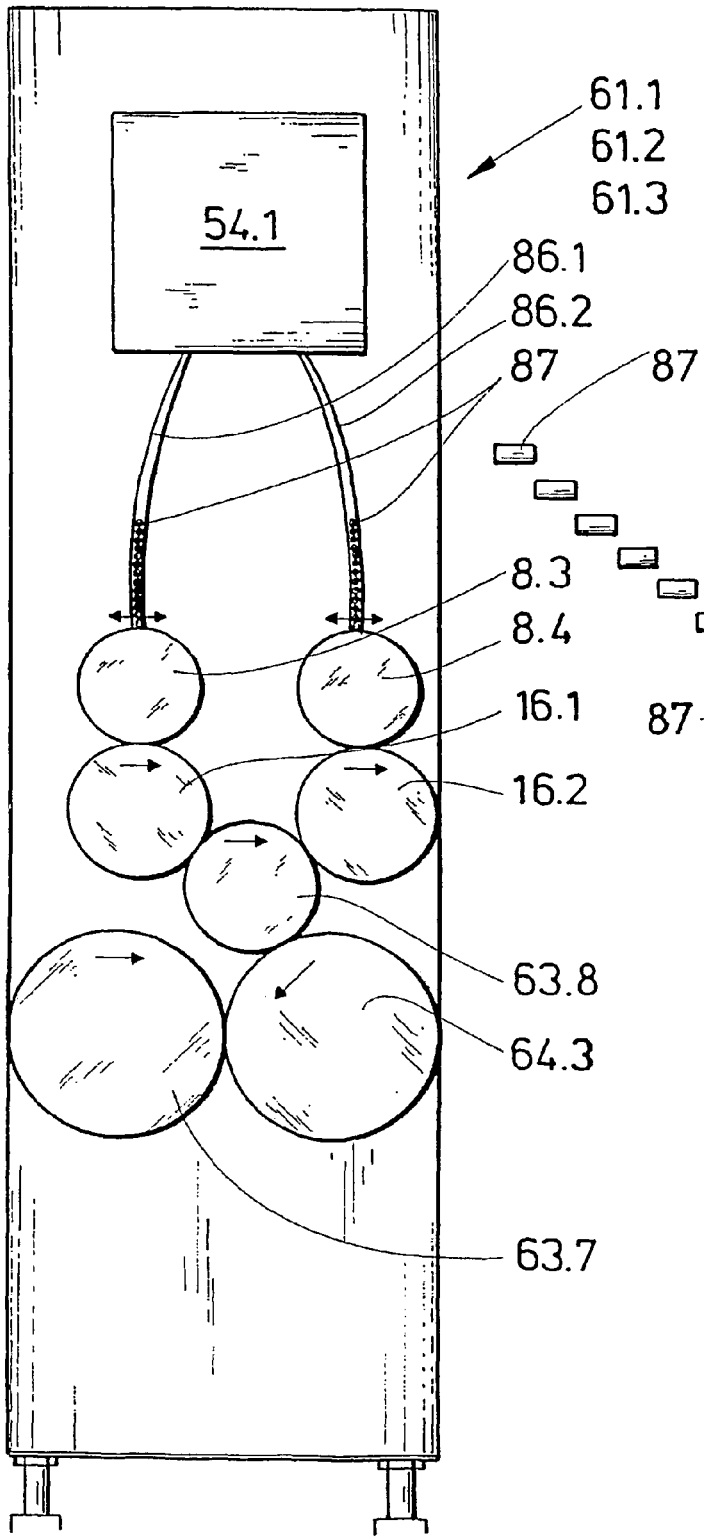
FIG. 6*a*) A schematic view of a functional unit according to the invention for hard elements.

FIG. 6*a*) shows a hard element unit 61.1-61.3 according to the invention. Hard filter elements 87 are supplied from a hard-element supply container 54.1 via two feeding chutes 86.1 and 86.2 to two removal drums 8.3 and 8.4. FIG. 6*a*) indicates that the feeding chutes 86.1 and 86.2 can be realized so as to be mobile to ensure the most careful transfer possible of the hard filter elements 87 to the removal drums 8.3 and 8.4. The removal drums 8.3 and 8.4 can also be designed accordingly to permit the fastest possible transfer of many elements. With respect to this, we want to point in particular to the applicant's own patent application with the title "ÜBERGABEEINRICHTUNG UND MULDEN-TROMMEL SOWIE VERFAHREN ZUR ÜBERGABE VON ZIGARETTEN-KOMPONENTEN" [Transfer Device and Trough Drum as well as Method for Transferring Cigarette Components], with the official file number DE 101 46 992.6. The content of the aforementioned patent application by the applicant is to be incorporated fully into the present application.

Figure 6B:
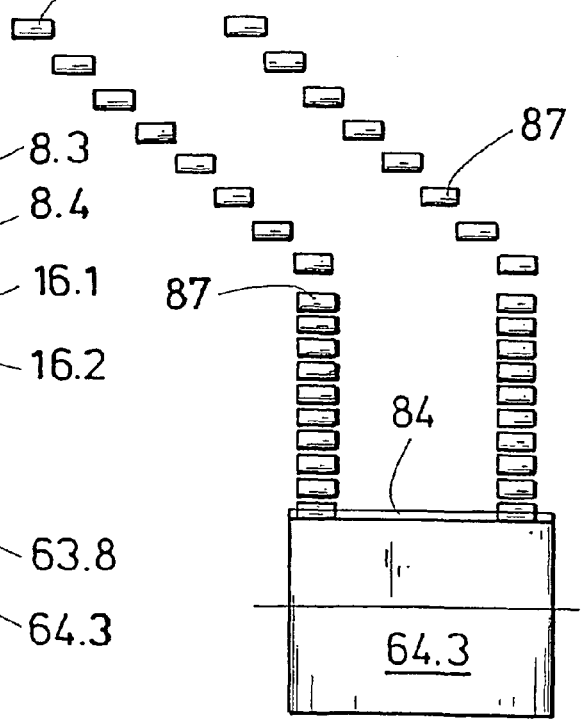
FIG. 6*b*) A schematic arrangement of filter segments, approximately arranged as indicated in the drums shown in FIG. 6*a*).

The hard filter elements 87, transferred in a staggered formation as indicated in FIG. 6*b*), are then transferred to pushing drums 16.1 and 16.2 in which the hard filter elements 87 are arranged cross-axially in the successively following holding troughs. The cross-axially aligned hard filter elements are transferred via a transfer drum 63.8 to the combining drum 64.3 of this unit and are then transferred to the transfer drum 63.7.

Figure 7:
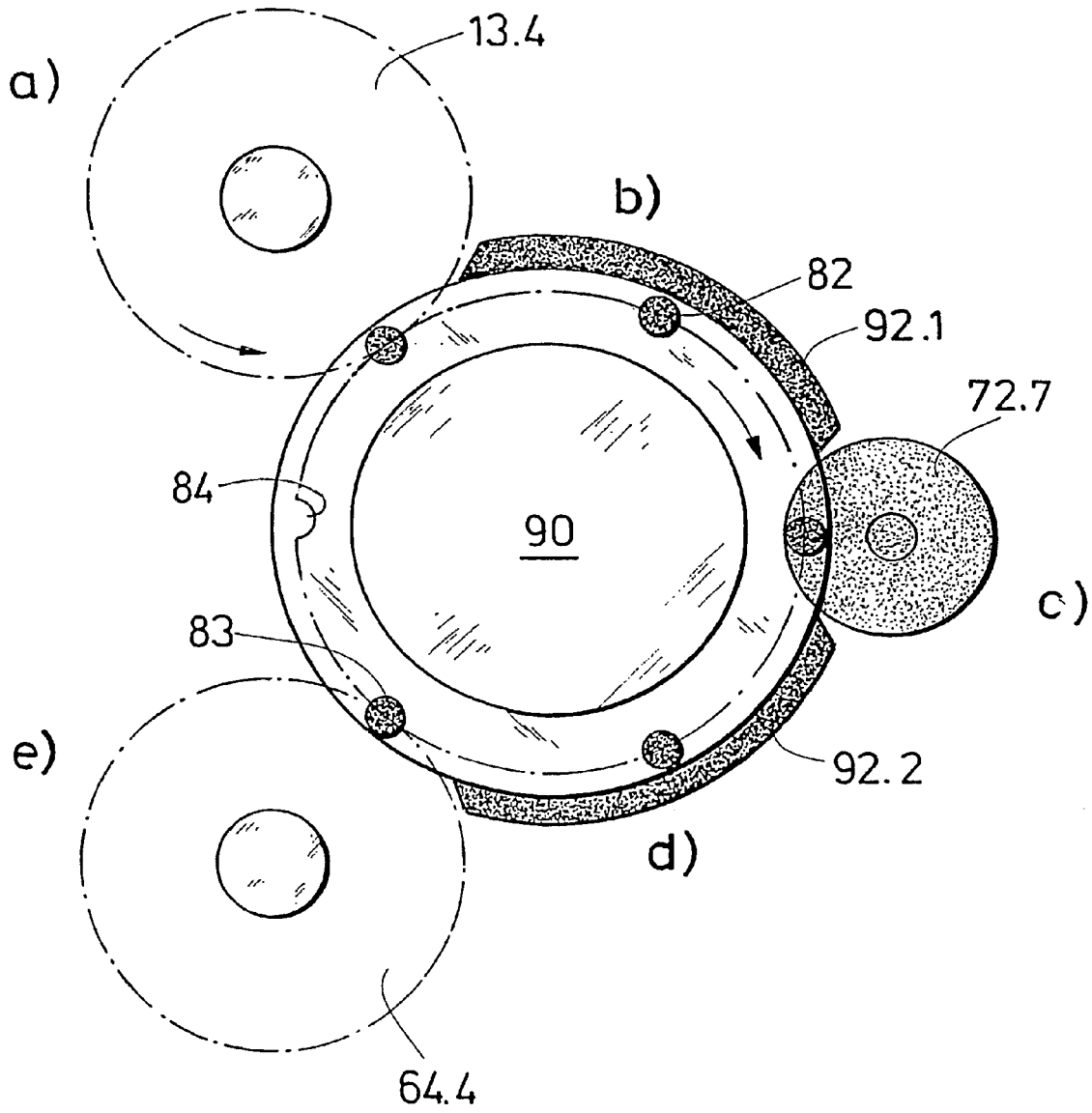
FIG. 7A schematic view from above of a portion of a functional unit according to the invention with a trough drum as defined for the invention.

FIG. 7 contains a schematic view from above of a portion of a soft-element unit 604 or 605.1-605.6 according to the invention, wherein a central component of a soft-element unit 604 or 605.1-605.6 according to the invention in particular is represented by the pushing/cutting/pushing drum 90. Corresponding filter elements 82, for example filter elements with double the usable length, are transferred while in a staggered formation from a staggering drum 13.4 at position a) to the drum 90. In movement direction of drum 90, the transferred filter elements 82 are then positioned cross-axially aligned in the holding troughs 84. A trough cover 92.1 is provided for this, which prevents the filter elements 82 from falling out if, for example, the suction air holding the filter elements in place is turned off to displace the respective filter elements. This operation is shown in position b).

In position c), the respective filter element 82 is cut with a circular blade 72.7 into two filter plugs 83. The two filter plugs 83 are then moved away from each other in position d). For this, a portion of the suction air that holds the filter plugs in place is turned off, so that a trough cover 92.2 is necessary at this location as well. In position e), the filter plugs 83 are then transferred to the combining drum 64.4 and, if necessary, combined with additional filter plugs and/or filter elements already positioned on this drum.

Figure 8:
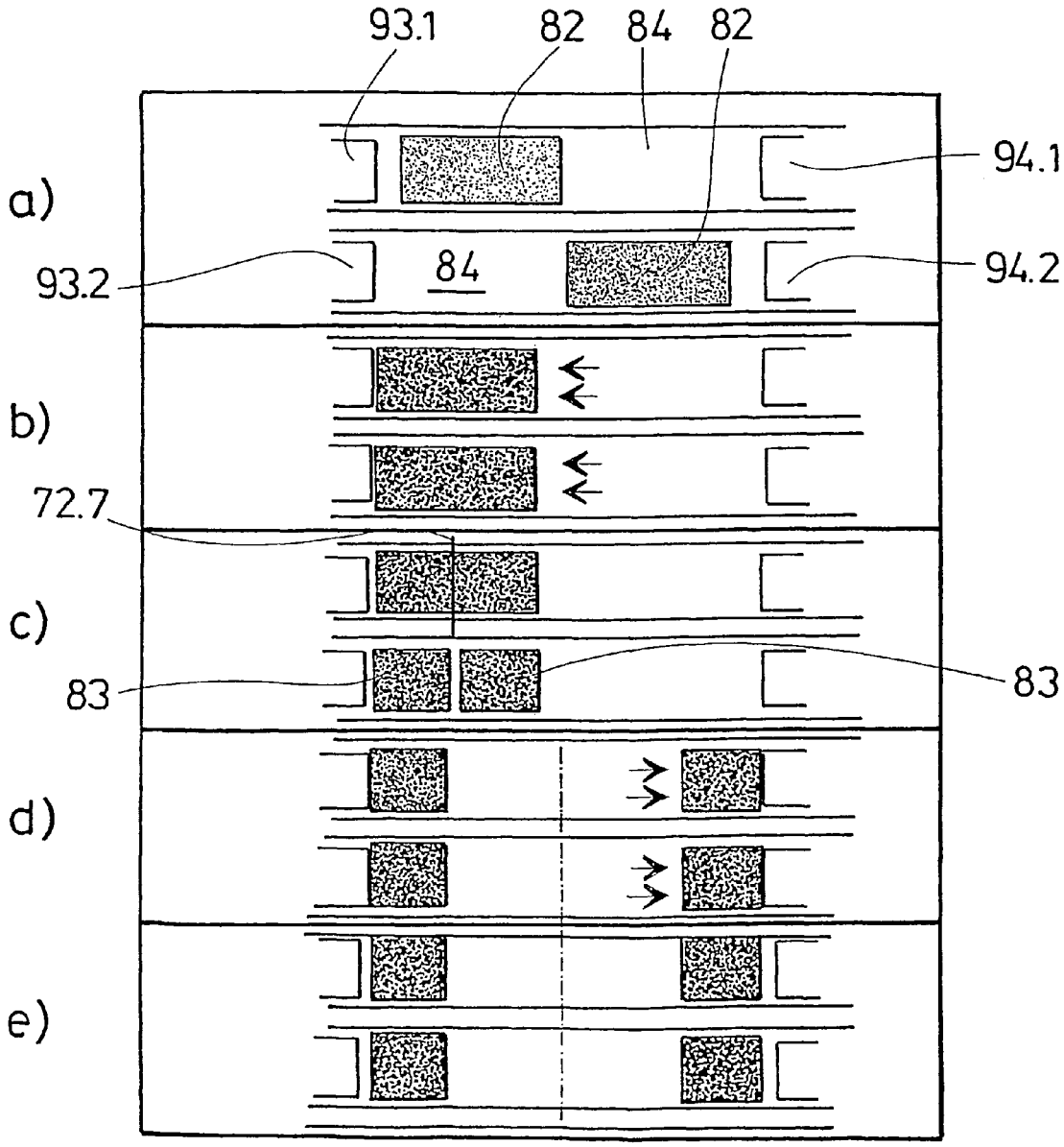
FIG. 8 Various filter segment positions in respectively two holding troughs of the trough drum according to the invention, shown in FIG. 7, in the positions a) to e) as shown in FIG. 7.
Figure 9:
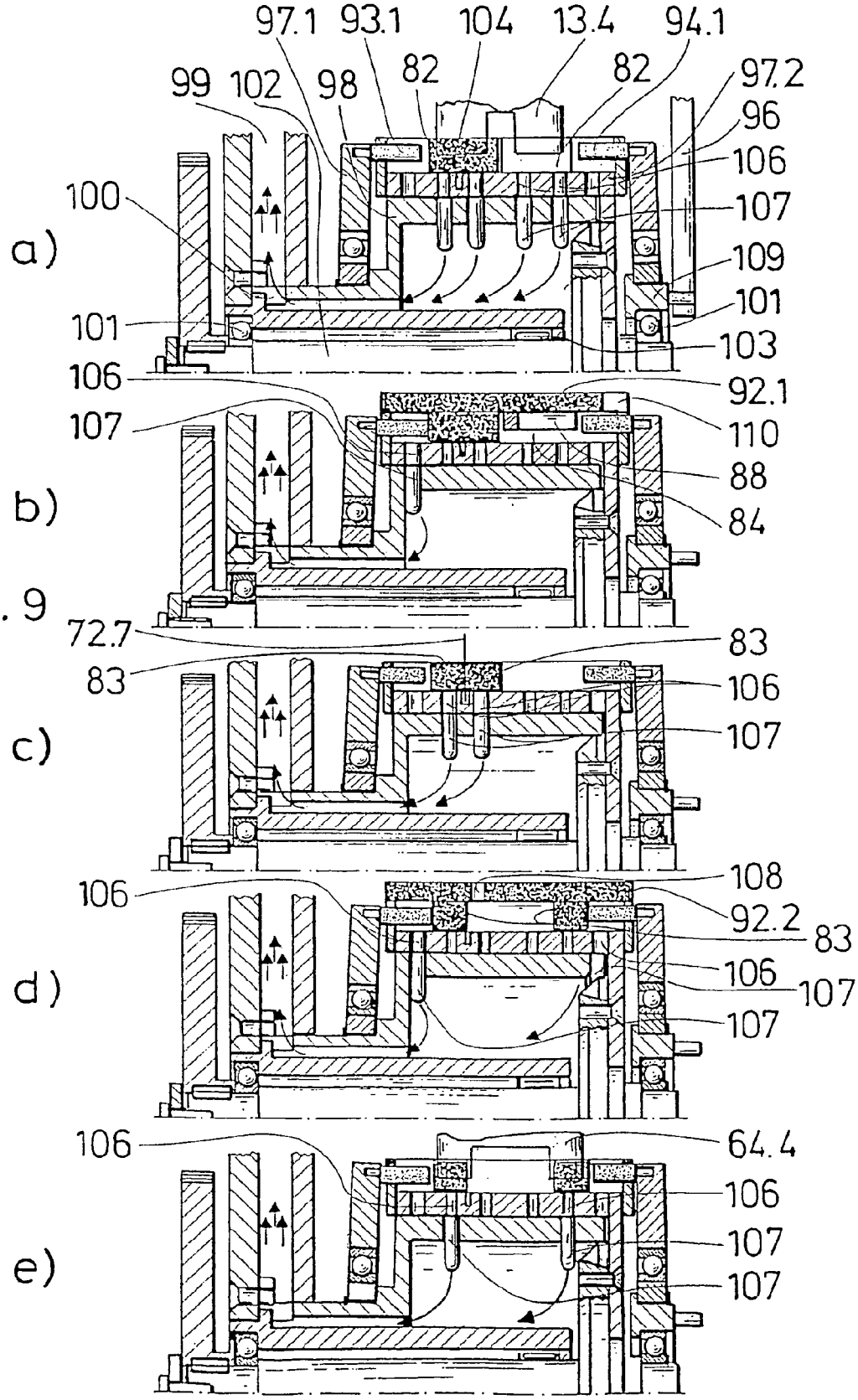
FIG. 9A schematic, semi-sectional view with five different cross sections a) to e) of the trough drum according to the invention as shown in FIG. 7.

FIG. 8 shows the mode of operation of the pushing/cutting/pushing drum 90 according to the invention. Positions a) to e) respectively show the elements essential to the operation. FIG. 8*a*) shows the transfer of the staggered filter elements 82 into the holding troughs 84. According to FIG. 8*b*), suction air then acts from the left side onto the filter elements 82, so that these move to the left until they reach the left end stop 93 and/or 93.2. A pusher element 88 that is not shown in FIG. 8, for example, but is shown in FIG. 9 can also be used in place of the suction air. The filter elements 82 are then positioned cross-axially aligned in the holding troughs 84.

In position c), the left end stop 93.1 and/or 93.2 is moved away slightly from the filter elements 82, so that a circular blade 72.7 can make a cut resulting in filter plugs 83.

In position d), suction air is used between the elements to move them away from each other, so that both filter plugs 83 come to rest against the two end stops 93.1 and 93.2 as well as 94.1 and 94.2, meaning on the left and right. In position e), the left and right end stops are moved slightly away from the filter plugs 83, so that these can be transferred freely to a different drum.

The different positions a) to e) in FIG. 9 show respectively schematic semi-sectional representations of the pushing/cutting/pushing drum 90 according to the invention. In position a), the filter plugs 82 are arranged in a staggered formation, one behind the other. The filter element 82 on the left is shown in a sectional representation and the filter element 82, arranged on the right, is shown in a view from above. The filter elements 82 are held in place inside holding trough 84 with suction air flowing through air holes 106 and 107. The suction air is controlled with an air-control element 98, depending on the rotational position of the drum 90. In this position, suction air is admitted via four air holes 106 and 107 and a notched-out section 100 to the air outlet 99. The direction of the suction air is shown with arrows. The drum 90 moves with the aid of a shaft 102 that is positioned in ball bearings 101 and a needle bearing 103. A wobble plate 97.1 and/or 97.2 is furthermore shown to which the left and right end stops 93.1 and/or 93.2 and 94.1 and/or 94.2 are attached. The wobble plate movement is controlled by a curved body 109, which is supported by a torque support 96.

In position b), showing a schematic semi-section through the drum 90 according to the invention, the filter elements 82 are shown arranged cross-axially, one behind the other. A pusher element 88 is furthermore shown schematically, by means of which the filter element arranged behind the frontal filter element is pushed to a position where it is aligned with the frontal filter element. In place of the schematically shown pusher element 88, it is also possible to displace the element with suction air, as otherwise indicated in FIG. 8*b*). No pusher element is needed in that case. Insofar, it relates to an alternative embodiment shown in the same drawing for the sake of simplicity.

In position b) of FIG. 9, air is blown from the left against the filter elements 82 by way of the air holes 106 and 107 that are located on the far left. As a result, the filter elements 82 move toward the left end stop 93.1. For this, the remaining air holes 106 are closed off with the air control element 98. A trough cover 92.1 is provided to prevent the filter elements from falling out of the troughs. This trough cover 92.1 is provided with an opening 110 or a notching 110 on the right side for admitting environmental air, so that during the suctioning of the filter elements toward the left, no vacuum is created on the right side which could prevent the filter elements from moving toward the left.

In position c) of FIG. 9, the left end stop is moved slightly toward the left, so that a cut can be made with a circular blade 72.7, which engages in the cutting groove 104, without squeezing the filter element arranged on the left. In this position, the filter elements 82 and/or the cut filter plugs 83 are again held in place with suction air.

In position d) of FIG. 9, the cut filter plugs 83 are moved away from each other. For this, suction air is supplied to the left side of the trough as well as the right side of the trough 84, meaning through the respective air holes 106 and 107. An air hole 108 is provided in the trough cover 92.2, in the area of the right side of filter plug 83 that is arranged on the left, so that no vacuum can develop between the filter plugs that move away from each other.

In position e) of FIG. 9 finally, the respective end stops 93.1 and/or 93.2 and 94.1 and/or 94.2 are initially moved away from the filter plugs 83, so that these can be transferred to the combining drum 64.4.

Thus, the drum according to the invention in particular is used to align, cut and space apart filter plugs. As a result, the downstream positioned drums 74.1, 63.4 and 75.1, for example shown schematically in FIG. 4*a*), can be replaced by a single drum 90, so that the functional unit according to the invention can be configured extremely space saving.

Figures 10A, 10B:
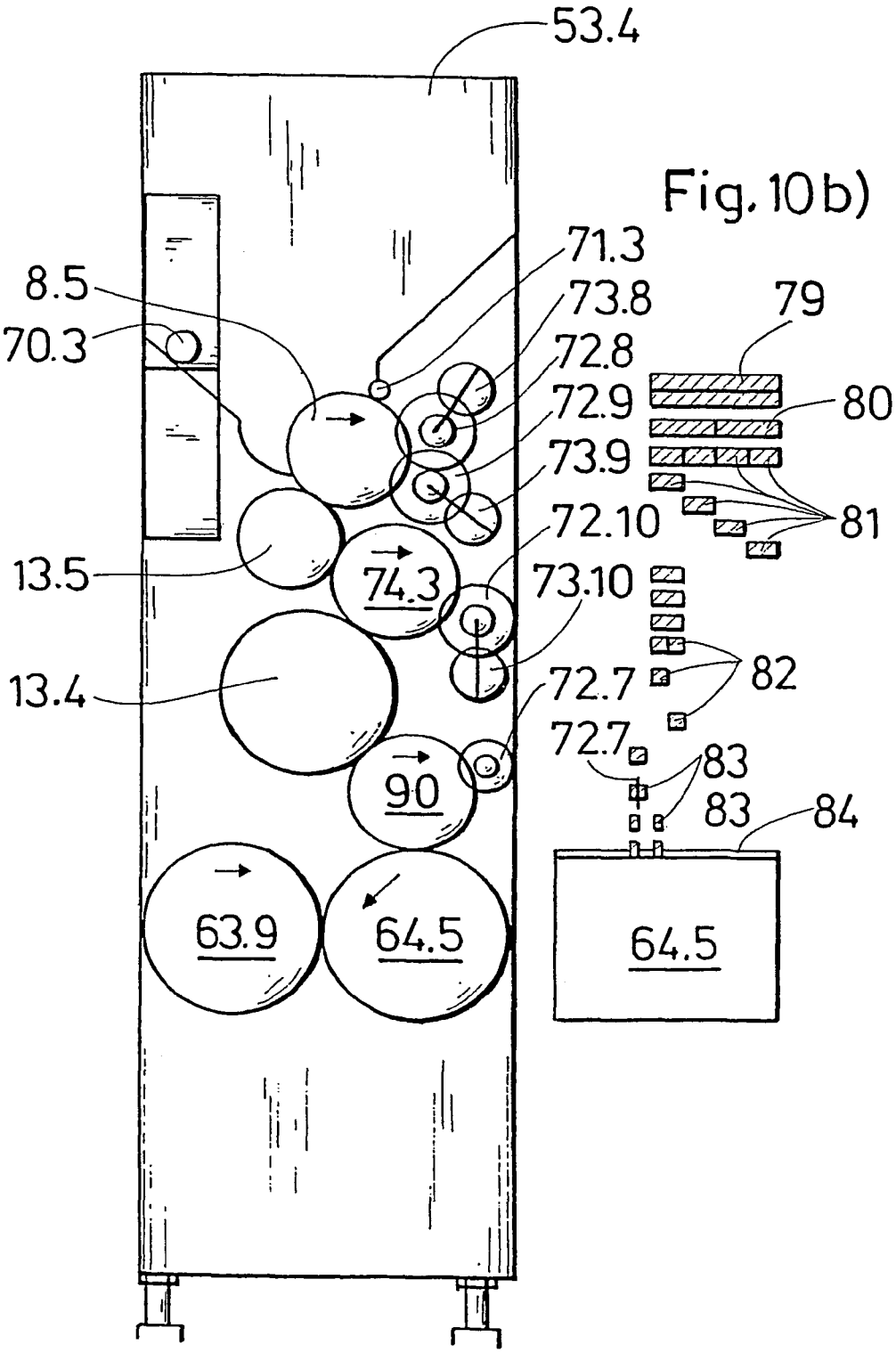
FIG. 10*a*) A schematic representation of a different embodiment of a functional unit according to the invention for soft elements.
FIG. 10*b*) A schematic arrangement of filter segments as positioned in the respective drums, shown in FIG. 10*a*).

FIG. 10*a*) schematically shows a different embodiment of a soft-element unit 605.3 according to the invention, by means of which two individual filter segments 83 are supplied to a combining drum 64.5. Soft filter rods 79, e.g. made from cellulose acetate, are supplied via a feed element 70.3 to a soft-element supply container 53.4. The respective filter rods and/or filter elements 79, for example having 16 times the usable length, are removed with a removal drum 8.5. The diverter roll 71.3 is provided for a secure removal of the filter elements 79.

The filter elements 79 are then cut on the removal drum 8.5 into four filter elements 81 with four times the usable length by means of a first circular blade 72.8 and a second circular blade 72.9, which are always kept sharpened by sharpening means 73.8 and 73.9. The cut filter elements 81 are then transferred to a staggering drum 13.5 and are arranged in a staggered formation on the staggering drum 13.5, as shown in FIG. 10*b*). The initially staggered filter elements 81 are then displaced cross-axially aligned on the following pushing/cutting drum 74.3 and cut into respectively two filter elements 82 with 2 times the usable length with the aid of an additional rotating circular blade 72.10. These filter elements as then transferred in a staggered formation to the staggering drum 13.4. This drum is followed by the pushing/cutting/pushing drum 90 according to the invention, by means of which the filter elements with 2 times the usable length 82 are cut into filter elements with one time the usable length 83 and separated, so that they can be transferred to the combining drum 64.5. The combining drum 64.5 is followed by the transfer drum 63.9, to which the filter elements 83 are then transferred.

Figure 11:
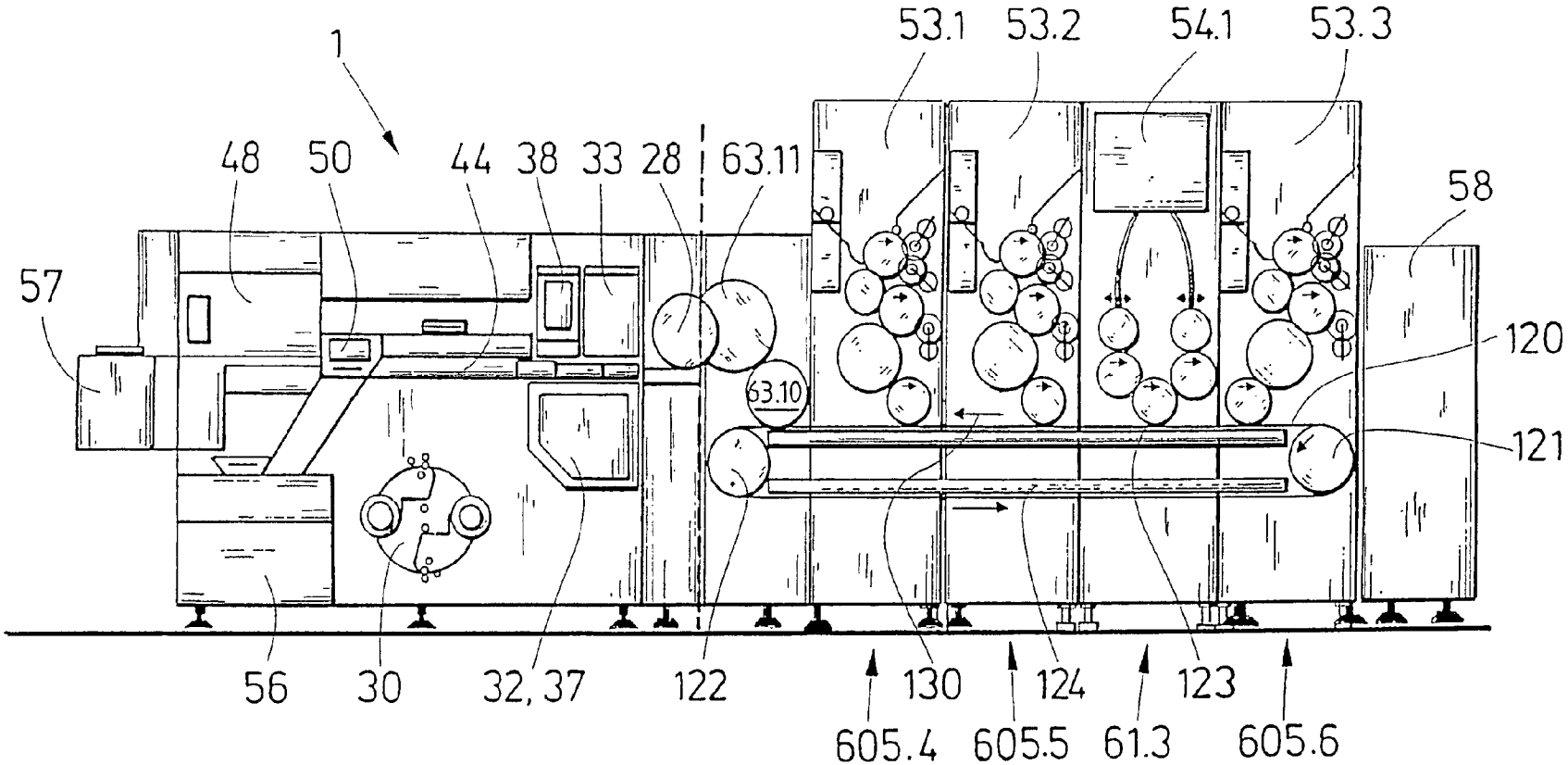
FIG. 11A schematic view from the side of an additional exemplary embodiment of a multi-segment filter production machine according to the invention, comprising a continuous process device and a different group-forming device with a conveying belt according to the invention.

FIG. 11 shows a schematic view from the side of a different embodiment of a multi-segment filter production machine according to the invention with a continuous process device and a different group combining device according to the invention. The combining drums 64.1-64.5, shown in FIGS. 2 and 3, as well as the transfer drums 63.5, 63.6. 63.7 and 63.9 that are operatively connected thereto, are replaced by a conveyor belt 120 which, for this special embodiment, extends across the four functional units 605.4-605.6 and 61.3 shown herein. Depending on the production requirements for the multi-segment filters, corresponding soft elements and hard elements are processed and transported with the aid of the different drums in the functional elements 605.4-605.6 and 61.3 and are deposited by means of a correspondingly adapted transfer drum onto the conveying belt 120. In the process, the filter segments are deposited into respectively provided holding troughs 131. The conveying belt 120 and/or a plurality of conveying belts 120.1-120.3 is and/or are moved with the aid of a drive wheel 121 and deflection wheel 122 in conveying direction 130. A vacuum box 123 is provided to keep the filter segments inside the holding troughs of the conveying belt 120. The function of this vacuum box is described in further detail in the following by referring to the FIGS. 12 and 13.

Once all filter segments for a multi-segment filter and/or a double multi-segment filter are deposited, they are transferred with a transfer drum 63.10 and an additional transfer drum 63.11 to the turning drum 28 which is known per se. Following this, they can be processed by wrapping material around a continuous filter rope in longitudinal axial direction, for example in the applicant's known KDF machine. A cleaning box 124 is also provided for cleaning the conveying belt 120 and/or the conveying belts 120.1-120.3, that is to say in a position in which no filter segments are located inside the troughs. Blast air, for example, can be used for this.

Figure 12A:
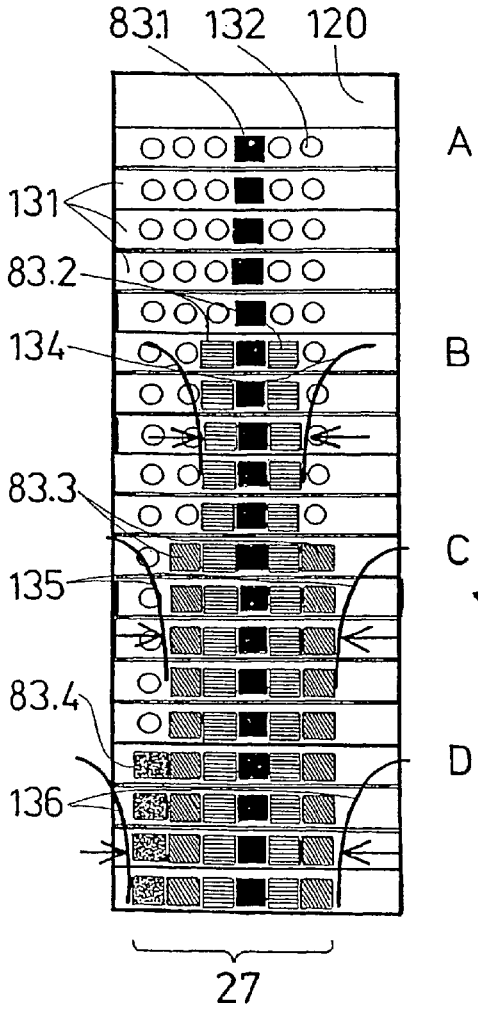
FIG. 12*a*) A schematic view from above of a conveying belt with corresponding filter segments.
Figure 12B:
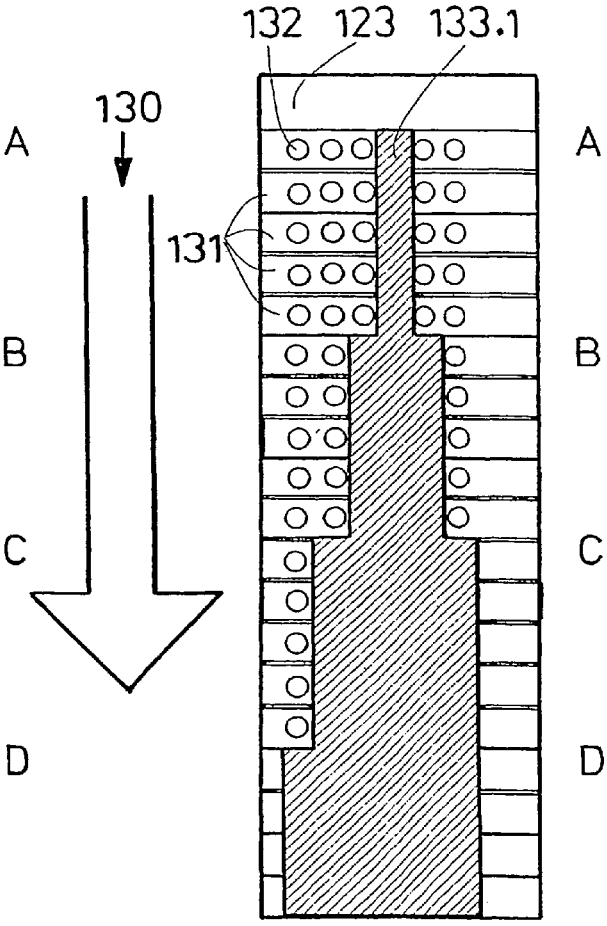
FIG. 12*b*) A schematic view from above of the embodiment of a suction element used for the deposited filters as shown in FIG. 12*a*).

FIGS. 12*a*) and 12*b*) schematically show the fitting-on of filter segments in an exemplary embodiment, wherein the associated vacuum box 123 is shown in FIG. 12*b*). The conveying belt 120 initially moves in conveying direction 130. FIG. 12*a*) shows corresponding vacuum openings 132 which, if admitted with vacuum, keep the filter segments 83.1-83.4 in their positions on the vacuum opening 132. The position A corresponds to the position in which the soft element unit 605.6 deposits a filter element 83.1 into a holding trough 131, approximately in the center of the conveying belt. Following this, two hard elements 83.2 are deposited on the conveying belt at position B, in the region of the hard-element unit 61.3. The filter elements 83.1 and 83.2 are then pushed together with a first pusher element 134. Following this, two soft filter elements 83.3 are deposited on the outside of the previously deposited filter elements, that is to say in the soft-element unit 605.5, at position C. These soft elements are also pushed against the previously deposited filter elements by means of a pusher element 135. An additional soft element 83.4 is finally deposited in the soft-element unit 605.4, on the left side at position D, and the elements are then pushed together with a pusher element 136, thus resulting in a filter rod group 27.

FIG. 12*b*) schematically shows the positioning of a vacuum opening 133.1 of the vacuum box 123, wherein several vacuum openings 132 are also drawn into the associated holding troughs 131 for the purpose of illustration. It is clearly visible that the vacuum opening 133.1 becomes larger in conveying direction, such that the respectively deposited filter elements 83.1-83.4 can be admitted with vacuum.

Figure 13A:
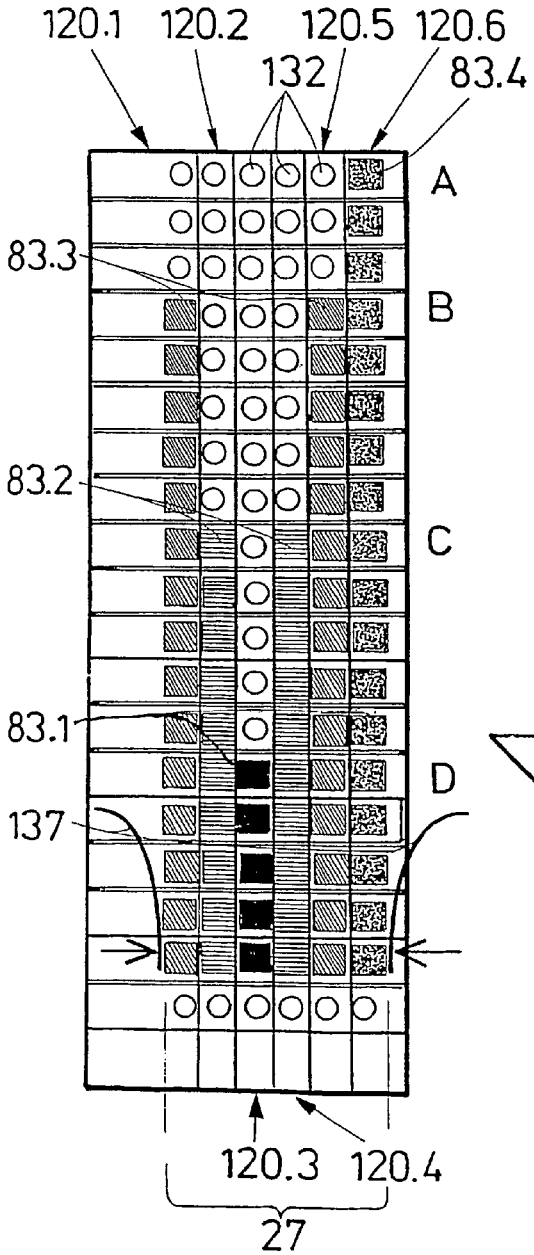
FIG. 13*a*) A schematic view from above of several conveying belts, on which the filters are deposited differently than in FIG. 12*a*).
Figure 13B:
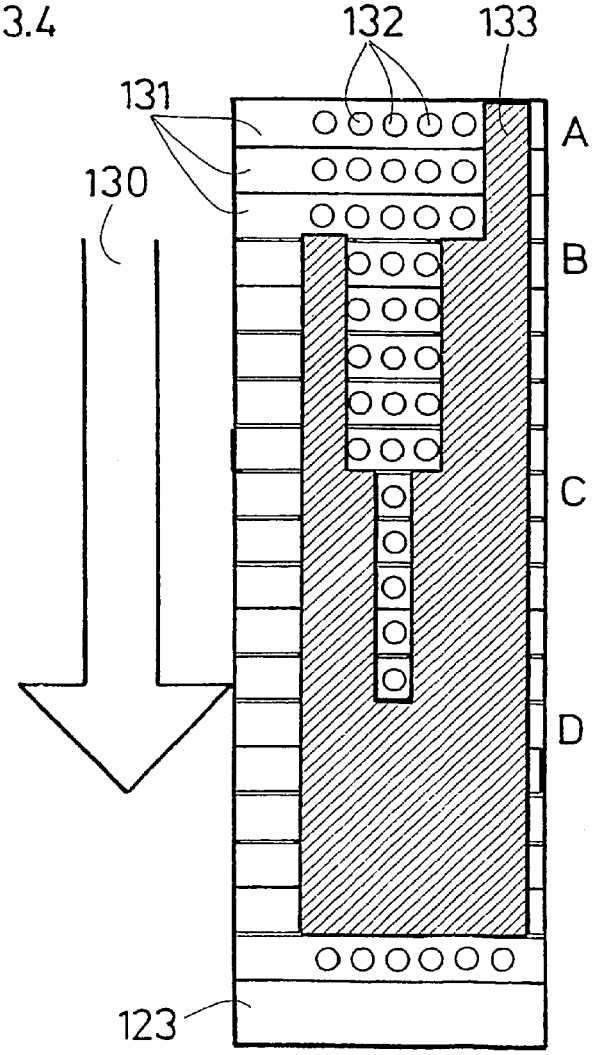
FIG. 13*b*) A schematic view from above of the suction element openings as they are positioned with respect to the deposited filters shown in FIG. 13*a*).

FIGS. 13*a*) and 13*b*) show a different embodiment according to the invention for depositing filter elements on a conveying belt 120 and/or as shown in FIG. 13*a*) on six conveying belts 120.1-120.6. With this method of depositing the filter elements, the filter elements on the outside are deposited first while the filter element on the inside is deposited last. At the end, a pusher element 137 pushes together the deposited filter elements to form a filter rod group 27. FIG. 13*b*) correspondingly also shows the vacuum opening 133.2, which corresponds to this type of filter deposit on the conveying belt and/or belts.

The advantage of using a conveying belt in place of conveying drums is that no radial forces act upon the filter segments because of the continuous conveying operation, thus ensuring an extremely careful transport. In addition, there are fewer transfers and fewer instances of the air pressure being turned on and/or off, thus resulting in a less noisy arrangement. Finally, the production material is always within the visual range of the operating personnel, so that malfunctions can be detected quickly.

The use of independent functional units in a device for combining groups of filter segments to produce multi-segment filters, for example, permits an increase in the production output of hard elements by using several modules. A high production output is furthermore possible if only soft modules and/or soft-element units are used. In particular two to five filter segments per multi-segment filter can thus be produced. Corresponding granulates are preferably manufactured first and are then inserted into hard elements.

The machine expenditure is extremely low as a result of the devices and/or apparatuses according to the invention. The operational risk is furthermore low since known methods are used for some processes, in particular the known continuous process or, for example, the process described in German reference DE-OS 24 52 749, which is used in the applicant's continuous process machine KDF.

| Reference Number List | |
|---|---|
| 1 | continuous process device; |
| 2 | group-forming device |

-continued

| Reference Number List | |
|---|---|
| 3 | storage container |
| 4 | storage container |
| 6 | filter rod |
| 7 | filter rod |
| 8 | removal drum |
| 8.1- | removal drum |
| 8.5 | removal drum |
| 9 | removal drum |
| 11 | cutting device |
| 12 | cutting device |
| 13 | staggering drum |
| 13.1- | staggering drum |
| 13.6 | staggering drum |
| 14 | staggering drum |
| 16 | pushing drum |
| 16.1 | pushing drum |
| 16.2 | pushing drum |
| 17 | pushing drum |
| 18 | acceleration drum |
| 19 | acceleration drum |
| 21 | cutting drum |
| 22 | cutting drum |
| 23 | cutting device |
| 24 | cutting device |
| 26 | combining drum |
| 27 | filter-rod groups |
| 28 | turning drum |
| 29 | bobbin |
| 30 | bobbin holder |
| 31 | wrapping paper tape |
| 32 | glue-application device |
| 33 | glue-storage container |
| 34 | application nozzle |
| 36 | application nozzle |
| 37 | glue-application device |
| 38 | storage container |
| 41 | area of deposit |
| 42 | curing agent |
| 43 | heating device |
| 44 | format chamber |
| 46 | gluing chamber |
| 47 | cooling device |
| 48 | cutting device |
| 49 | combination filter rods |
| 50 | rope cutter |
| 53.1- | soft-element supply container |
| 53.4 | soft-element supply container |
| 54.1- | hard-element supply container |
| 54.2 | hard-element supply container |
| 56 | refuse container |
| 57 | push-in drum |
| 58 | energy supply unit |
| 604 | soft element unit |
| 605.1- | soft element unit |
| 605.6 | soft element unit |
| 61.1- | hard element unit |
| 61.3 | hard element unit |
| 62 | transfer unit |
| 63.1- | transfer drum |
| 63.11 | transfer drum |
| 64.1- | combining drum |
| 64.5 | combining drum |
| 70.1- | feed element |
| 70.3 | feed element |
| 71.1- | diverter roll |
| 71.3 | diverter roll |
| 72.1- | circular blade |
| 72.10 | circular blade |
| 73.1- | sharpening element |
| 73.10 | sharpening element |
| 74.1- | pushing/cutting/pushing drum |
| 74.3 | pushing/cutting/pushing drum |
| 75.1- | pushing/transfer drum |
| 75.2 | pushing/transfer drum |
| 79 | filter element (16 times usable length) |
| 80 | filter element (8 times usable length) |
| 81 | filter element (4 times usable length) |
| 82 | filter element (2 times usable length) |

-continued

| Reference Number List | |
|---|---|
| 83- | filter plugs |
| 83.1 | filter elements |
| 84 | holding trough |
| 86.1- | feeding chute |
| 86.2 | feeding chute |
| 87 | hard filter elements |
| 88 | pusher element |
| 90 | pushing/cutting/pushing drum |
| 90.1 | pushing/cutting/pushing drum |
| 92.1- | trough cover |
| 92.1 | trough cover |
| 93.1- | left end stop |
| 93.1 | left end stop |
| 94 | right end stop |
| 96 | torque support |
| 97.1- | wobble plate |
| 97.2 | wobble plate |
| 98 | air-control element |
| 99 | air outlet |
| 100 | notched section |
| 101 | ball bearing |
| 102 | shaft |
| 103 | needle bearing |
| 104 | knife groove |
| 106 | air hole |
| 107 | air hole |
| 108 | air hole |
| 109 | curved body |
| 110 | notched section |
| 120 | conveying belt |
| 120.1- | conveying belt |
| 120.3 | conveying belt |
| 121 | drive wheel |
| 122 | reversing wheel |
| 123 | vacuum box |
| 124 | cleaning box |
| 130 | conveying direction |
| 131 | trough |
| 132 | vacuum opening |
| 133.1- | vacuum opening |
| 133.2 | vacuum opening |
| 134 | pusher element |
| 137 | pusher element |

The invention claimed is:

1. A device for combining groups of at least two different types of filter segments for producing multi-segment filters in the tobacco industry in a continuous process, comprising:

a plurality of independent functional units that supply individual filter segments to a transfer unit which combines the at least two individual filter segments to form a multi-segment filter, said independent functional units having a supply container for a respective individual filter segment, wherein each of the plurality of independent functional units is a replaceable module, and wherein at least two adjacent functional units respectively include at least one conveying element, and at least one conveying belt including holding troughs for holding filter segments and operatively connected to the conveying elements.

2. The device of claim 1, wherein one of the functional units is provided for each type of filter segments.

3. The device of claim 1, wherein one of the functional units is provided for each group of filter segments.

4. The device of claim 1, wherein the conveying elements comprise at least one of combining drums and transfer drums.

5. The device of claim 1, wherein each of the functional units comprises at least one combining drum.

6. The device of claim 1, wherein each functional unit comprises at least one of the conveying element operatively connected to the at least one conveying belt.

7. The device of claim 1, wherein the at least one conveying belt has a horizontal conveying direction.

8. The device of claim 1, further comprising means for securing the filter segments inside the holding troughs.

9. The device of claim 1, further comprising means for displacing the filter segments inside the holding troughs.

10. The device of claim 1, further comprising at least one cleaning element for cleaning the at least one conveying belt.

11. The device of claim 1, wherein the at least one conveying belt includes a plurality of conveying belts arranged parallel to one another.

12. A multi-segment filter production machine, comprising:

the device of claim 1;

a continuous process device; and a transfer device for transferring groups of filter segments from the device of claim 1 to the continuous process device.

* * * * *